United States Patent [19]

Scott

[11] Patent Number: 4,981,267

[45] Date of Patent: Jan. 1, 1991

[54] FUEL INJECTION NOZZLE

[75] Inventor: Robert H. Scott, Chatham, Great Britain

[73] Assignee: Lucas Industries public limited company, Birmingham, England

[21] Appl. No.: 335,301

[22] Filed: Apr. 10, 1989

[30] Foreign Application Priority Data

Apr. 20, 1988 [GB] United Kingdom ..... 8809269

[51] Int. Cl.[5] ..... F02M 61/04

[52] U.S. Cl. ..... 239/533.3; 239/533.9

[58] Field of Search ..... 239/533.2–533.12

[56] References Cited

U.S. PATENT DOCUMENTS 4,096,999 6/1978 Eckert et al. ..... 239/533.5

4,591,100 5/1986 Gaskell et al. ..... 239/533.3

4,836,454 6/1989 Gaskell ..... 239/533.9

4,872,614 10/1989 Greeves et al. ..... 239/533.9

*Primary Examiner*—Andres Kashnikow

*Assistant Examiner*—William Grant

*Attorney, Agent, or Firm*—Nixon & Vanderhye

[57] ABSTRACT

A fuel injection nozzle of the inwardly opening type including a valve member surrounded by a sleeve, the valve member and sleeve both being movable by fuel under pressure supplied to an inlet. The valve member is biased into engagement with a seating by the action of a spring which acts on the valve member through a spring abutment. The sleeve acts on the spring abutment through an annular intermediate member. The extent of movement of the sleeve is limited by the engagement of the intermediate member with a stop surface and the extent of movement of the valve member is limited by the engagement of a step on the valve member with the intermediate member.

1 Claim, 1 Drawing Sheet

FUEL INJECTION NOZZLE

BACKGROUND OF THE INVENTION

This invention relates to a liquid fuel injection nozzle for supplying fuel to an internal combustion engine, the nozzle being of the so-called inwardly opening type and comprising a nozzle body, a blind bore extending inwardly from one end of the nozzle body, a seating defined at the blind end of the bore, an elongated valve member movable in the bore and shaped at one end for engagement with the seating to prevent fuel flow from a fuel inlet to an outlet, the valve member defining a surface against which fuel under pressure at the fuel inlet can act to urge the valve member away from the seating to allow fuel flow through said outlet, resilient means biasing the valve member into contact with said seating and a sleeve surrounding the valve member and slidable in said bore, said sleeve being exposed at one end to the pressure of fuel at the fuel inlet, the pressure of fuel acting on said sleeve producing a force which assists the initial movement of the valve member away from the seating.

Such nozzles are known in the art and provide for two stages of lift of the valve member away from the seating. The first stage of lift allows a restricted rate of fuel flow to the associated engine and the second stage of lift allows substantially unrestricted flow of fuel. The extent of movement of the valve member away from the seating to achieve the first stage of lift is critical and must therefore be carefully adjusted in the manufacture of the nozzle. The object of the present invention is to provide a fuel injection nozzle of the kind specified in a simple and convenient form.

SUMMARY OF THE INVENTION

According to the invention a fuel injection nozzle of the kind specified comprises a reduced end portion on the valve member, said end portion being engaged by a spring abutment to urge the valve member into contact with the seating, and an annular intermediate member surrounding said reduced end portion of the valve member, said intermediate member being partly located in a recess defined by an enlarged portion of the bore at the open end thereof, the arrangement being such that in use when fuel under pressure is supplied through said fuel inlet the fuel pressure will produce forces acting on the sleeve and the valve member, the force acting on the sleeve being transmitted to the spring abutment through the intermediate member, and when the combined force is sufficient to overcome the force exerted by the resilient means the valve member will be lifted from its seating to allow restricted flow of fuel through the outlet, the extent of the initial movement of the valve member being determined by the engagement of the intermediate member with a stop surface, the further movement of the valve member to allow substantially unrestricted flow of fuel through the outlet taking place when the fuel pressure at the fuel inlet has increased sufficiently so that the force acting on the valve member overcomes the force exerted by the resilient means.

According to a further feature of the invention the extent of further movement of the valve member is limited by the engagement of a step defined on the valve member with said intermediate member.

BRIEF DESCRIPTION OF THE DRAWINGS

An example of a fuel injection nozzle in accordance with the invention will now be described with reference to the accompanying drawings in which.

DETAILED DESCRIPTION OF PREFERRED EMBODIMENTS

Figure 1:
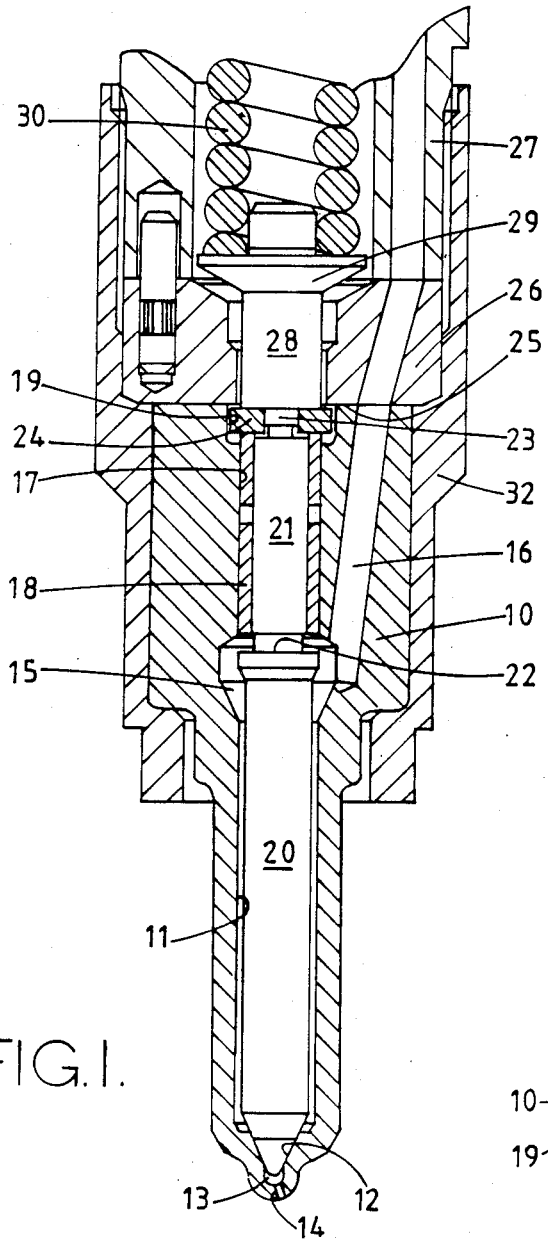
FIG. 1 is a part sectional side elevation of a portion of the nozzle.

Referring to the drawings the nozzle comprises a nozzle body 10 of stepped cylindrical form within which and extending from the wider end of the body, is a blind bore 11. At the blind end of the bore there is formed a frusto conical seating 12 which leads into a "sac" volume 13 from which extends an outlet 14. Intermediate the ends of the bore there is formed an enlargement 15 from which extends an inlet passage 16 which opens onto the wider end of the body 10. The portion 17 of the bore which lies between the enlargement and the wider end of the body is of increased diameter and within this portion of the bore there is mounted a slidable sleeve 18. In addition, the portion 17 of the bore adjacent the end of the body is enlarged to define an annular recess 19.

Extending within the bore is a valve member 20 which at its end adjacent the seating is shaped for cooperation with the seating. A clearance is established between the valve member and the main portion of the bore 11 and the valve member has a reduced portion 21 which is slidable within the sleeve. At the junction of the reduced portion of the valve member and the main portion thereof there is defined a step 22. Moreover, at the end of the valve member remote from the seating there is defined a reduced end portion 23. Surrounding the reduced end portion of the valve member and axially slidable thereon is an annular intermediate member which is partly located within the recess 19.

The nozzle body in the particular example, is secured against a stop face 25 which is defined by an annular distance piece 26 which is located between the nozzle body and a hollow cylindrical nozzle holder 27. The nozzle body, the distance piece and the holder are held in assembled relationship in known manner, by means of a cap nut 32. The stop face 25 overlies the recess 19 and extending through an aperture in the distance piece 26 is a cylindrical extension 28 of a spring abutment 29. The spring abutment 29 is engaged by one end of a coiled compression spring 30 which is housed within the holder, the opposite end of the spring engaging an adjustable abutment not shown.

The distance piece 26 and the holder 27 define fuel passages which connect with the passage 16, the holder having a fuel inlet for connection in use to a fuel injection pump.

Figure 2:
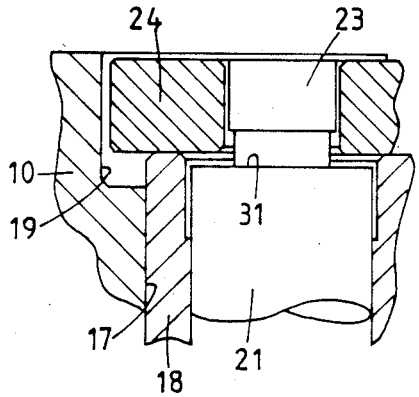
FIG. 2 is a view to an enlarged scale of part of the nozzle seen in FIG. 1.

In the drawings the valve member is shown in the closed position and as more clearly seen in FIG. 2, in the closed position the end of the reduced end portion 23 of the valve member lies slightly below the end surface of the wider end of the nozzle body. The cylindrical extension 28 of the spring abutment is in engagement with the valve member and when fuel under pressure is supplied to the inlet the fuel pressure acting on the sleeve 18 will move the sleeve upwardly into engagement with the intermediate member 24 which therefore will also engage with the end surface of the extension 28. It will also be noted from FIG. 2 that there is a clearance between a step 31 defined between the reduced end portion 23 and the portion 21 of the valve member, and the intermediate member 24.

In operation, when fuel under pressure is supplied to the enlargement 15, fuel pressure acts on the end surface of the sleeve 18 and if the sleeve is not in contact with the intermediate member 24 and the latter in contact with the extension 28 such contact will be established. The pressure acting on the sleeve and also upon the valve member will generate forces which oppose the action of the spring 30. When the combined forces are sufficient to overcome the force exerted by the spring, the valve member and the sleeve move upwardly to allow restricted fuel flow through the outlet 14. The extent of upward movement is determined by the abutment of the intermediate member 24 with the stop surface 25. Further movement of the sleeve and intermediate member is therefore prevented. However, as the pressure of fuel supplied to the enlargement 15 continues to increase, a pressure will be reached at which the pressure acting on the valve member alone is sufficient to cause further movement of the valve member against the action of the spring and the valve member lifts further to allow substantially unrestricted flow of fuel through the outlet 14. The extent of further movement of the valve member is limited by the engagement of the step 31 with the intermediate member 24.

When the supply of fuel by the injection pump ceases, the valve member and the sleeve are returned by the action of the spring 30. The sleeve 18 may under certain conditions of operation, move downwardly further than the valve member. However, the extent of such movement is limited by its abutment with the step 22. In order to prevent distortion of the sleeve due to unequal pressures along the working clearances defined between the sleeve 18 and the portion 17 of the bore and the portion 21 of the valve member, the sleeve is provided with apertures at intervals along its length. Moreover, as will be seen from FIG. 2, the end surface of the sleeve which engages the member 24 is chamfered and in addition there is relief of the initial portion of the bore in the sleeve adjacent the chamfered end thereof. An escape path for fuel leaking along the working clearance between the valve member and the sleeve may be provided.

The initial movement of the valve member is critical and this is determined by the depth of the reduced end portion 23 below the end surface of the nozzle body. This can be determined by machining the valve member to the appropriate length and the extent of further movement of the valve member is determined by the thickness of the intermediate member 24 and this can be machined to the appropriate thickness or a selection made from a range of members of differing thickness. Alternatively a shim may be provided between the step 31 and the intermediate member. It should be noted that neither of the two machining operations involve removing metal from the sleeve. There is therefore no risk of degrading the roundness, straightness etc. of the sleeve. As an alternative to the use of a shim or the grinding or selection of the intermediate member, the step 31 on the valve member can be ground to give the required range of movement of the valve member.

The cylindrical extension 28 of the spring abutment may need to be guided in the aperture in the distance piece to avoid sticking. In this case it is necessary to provide a leakage path for fuel into the chamber which contains the spring. Moreover, as shown the distance piece and holder are formed as two parts which have to be angularly located by means of a dowel. If desired however the two parts may be formed integrally.

As shown the outlet orifice 14 extends from the "sac" volume 13. The invention is equally applicable to nozzles of the type in which the orifice or orifices, extends from the seating zone. Moreover, the invention may be applied to a so-called pencil injection nozzle in which the nozzle body 10 and also the valve member are of considerable length and in which the equivalent of the skirt of the cap nut is integral with the body. In this case a cup shaped closure member is screwed into the skirt to form an abutment for the spring. The fuel inlet extends laterally from the body at a position below the skirt and the stop 25 is formed on a plate which is trapped by the end closure. In this case therefore pressure exerted by the spring can be adjusted using a shim interposed between the spring and the base wall of the closure member.

I claim:

1. A liquid fuel injection nozzle for supplying fuel to an internal combustion engine, the nozzle being of the so-called inwardly opening type and comprising:

a nozzle body, a blind bore extending inwardly from one end of the nozzle body, a seating defined at the blind end of the bore;

an elongated valve member movable in the bore having two ends and shaped at one end for engagement with the seating to prevent fuel flow from a fuel inlet to an outlet, the valve member defining a surface against which fuel under pressure at the fuel inlet can act to urge the valve member away from the seating to allow fuel flow through said outlet;

a sleeve slidable in the bore and surrounding at least a portion of the valve member, said sleeve being exposed at one end to the pressure of fuel, the pressure of fuel and said sleeve comprising a means for producing a force which assists initial movement of said valve member away from the seating;

a spring abutment engaging said other end portion of said valve member;

spring means, engaging said spring abutment, for urging the valve member into contact with the seating;

a recess defined by an enlarged portion of the bore at the end thereof remote from the seating;

an annular intermediate member at least partially surrounding said valve member, said intermediate member having a single planar surface adjacent said spring abutment being at least partially located in said recess; and a stop surface which partly overlies said recess and the arrangement being such that in use when fuel under pressure is supplied through said fuel inlet the fuel pressure will produce forces acting on the sleeve and the valve member against the force of said spring means, the force acting on the sleeve being transmitted to the spring abutment through the intermediate member, and when the combined force is sufficient to overcome the force exerted by the spring means the valve member will be lifted from its seating to allow a restricted flow of fuel through the outlet, the extent of the initial movement of the valve member being determined by the engagement of the intermediate member with said stop surface, further movement of the valve member to allow substantially unrestricted flow of fuel through the outlet taking place when the fuel pressure at the fuel inlet has increased sufficiently so that the force acting on the valve member overcomes the force exerted by the resilient means, said valve member including step means engageable with said intermediate member, for limiting further movement of the valve member, and in the closed position of the valve member, the intermediate member being spaced from said stop surface by a distance equal to said initial movement of the valve member.

* * * * *